United States Patent [19]

Gross

[11] Patent Number: 4,898,611

[45] Date of Patent: Feb. 6, 1990

[54] POLYMERIC ORE AGGLOMERATION AIDS

[75] Inventor: Anthony E. Gross, St. Charles, Ill.

[73] Assignee: 501 Nalco Chemical Company, Naperville, Ill.

[21] Appl. No.: 285,408

[22] Filed: Dec. 16, 1988

Related U.S. Application Data

[63] Continuation-in-part of Ser. No. 176,128, Mar. 31, 1988, abandoned.

[51] Int. Cl.[4] ..... C27B 1/14

[52] U.S. Cl. ..... 75/3; 423/27; 423/29; 423/30; 423/31; 75/97 R; 75/101 R; 75/103; 75/105; 75/118 R

[58] Field of Search ..... 423/27, 29, 30, 31; 75/118 R, 103, 105, 101, 97, 3

[56] References Cited

U.S. PATENT DOCUMENTS

| | | | |
|---|---|---|---|
| Re. 28,474 | 7/1974 | Anderson et al. | 260/29.6 H |
| 3,284,393 | 11/1966 | Vanderhoff et al. | 524/801 |
| 3,288,770 | 11/1966 | Butler | 210/734 |
| 3,692,673 | 9/1972 | Hoke | 710/728 |
| 3,920,599 | 11/1975 | Hurlock et al. | 260/29.64 |
| 4,256,705 | 3/1981 | Heinen et al. | 75/118 R |
| 4,256,706 | 3/1981 | Heinen et al. | 75/118 R |
| 4,703,092 | 10/1987 | Fong | 525/351 |
| 4,704,209 | 11/1987 | Richardson et al. | 210/734 |

FOREIGN PATENT DOCUMENTS

| | | | |
|---|---|---|---|
| 0225596 | 3/1986 | European Pat. Off. | 525/351 |

OTHER PUBLICATIONS

Silver and Gold Recovery from Low Grade Resources, by G. McClelland and S. D. Hill, from Mining Congress Journal 1981, pp. 17–23.

*Primary Examiner*—Gary P. Straub
*Assistant Examiner*—Paige C. Harvey
*Attorney, Agent, or Firm*—Kinzer, Plyer, Dorn, McEachran & Jambor

[57] ABSTRACT

The agglomeration of gold or silver ore fines is improved by the use of a water-soluble vinyl polymer as the agglomerating agent.

3 Claims, 4 Drawing Sheets

PERCOLATION TESTS ON GOLD ORE I
CEMENT (20 LB / TON)

O BLANK
NO POLYMER
COMP. 1.12 LB / TON
COMP. 1.25 LB / TON
COMP. 1.50 LB / TON

POLYMERIC ORE AGGLOMERATION AIDS

INTRODUCTION

This application is a continuation-in-part of application Ser. No. 176,128, filed Mar. 31, 1988, now abandoned.

Low grade gold and silver ores are leached by spraying barren cyanide solution onto a large heap of ore. As the solution percolates through the heap, the precious metal is dissolved out of the ore. The resulting pregnant solution is then collected for further processing. A major problem is segregation of fines in building the heap and migration of fines during percolation which results in channeling and/or blinding. To overcome the problem, the U.S. Bureau of Mines developed a process in which the ore is agglomerated with 5–20 lbs/ton cement binder and about 12% water or barren solution. Liquid is sprayed onto the tumbling ore-cement mixture. This tumbling action causes the coarse ore particles, fine particles, and cement to form balls or agglomerates. After curing for about 72 hours, the cement sets up and binds the agglomerates—thus preventing channeling and migration. Tumbling of the ore is obtained in practice with rotary agglomerators, pug mills, belt transfer points, or ore cascading down the side of the heap.

Even though the above process is beneficial it does not totally solve the problem leading to long leach cycles and/or slow percolation rates. In this invention a high molecular weight water-soluble vinyl addition polymer is inverted and added to the agglomerating liquid. As the data will show, the polymer increases the flow through the column and reduces the tendency of the fines to migrate and reduce the flow. The Bureau of Mines used a high molecular weight polyethyleneoxide (PEO) in a similar manner. However, this PEO does not achieve as high a flow rate and the agglomerates break down more rapidly than the polymers of this invention. A proposed mechanism is that the polymer helps tie up the fines in the agglomerating step enabling the cement, when it is used as a co-agglomerating agent, to better contact and bind the fines.

For a more detailed description of heap leaching and the agglomeration of ore fines with either lime or Portland cement, see "Silver and Gold Recovery from Low-Grade Resources" by G. E. McClelland and S. D. Hill *Mining Congress Journal,* 1981, pages 17–23.

BRIEF DESCRIPTION OF THE DRAWINGS

FIG. 1 is an electron photomicrograph of untreated ore, FIG. 2 is an electron photomicrograph of ore and Composition 1[1] polymer,

[1] See glossary

Figure 1:
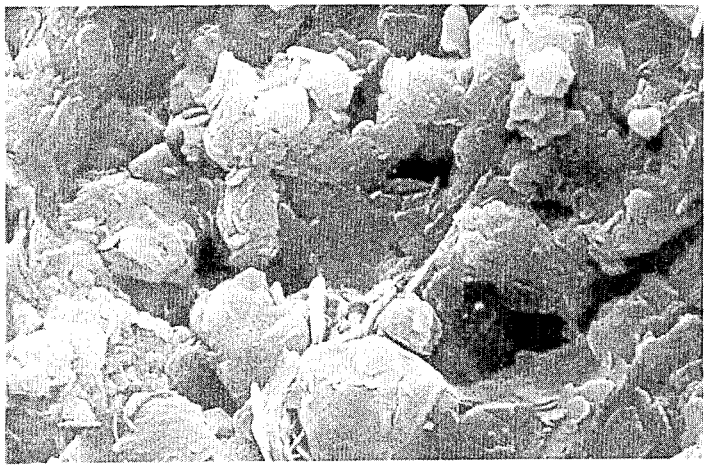
FIGS. 1–8 are a series of SEM pictures showing the interaction of polymer with inorganic agglomerating agents
Figure 2:
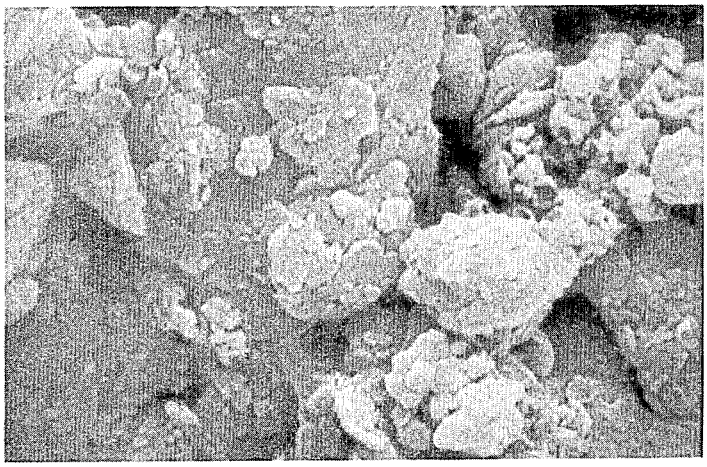
Figure 3:
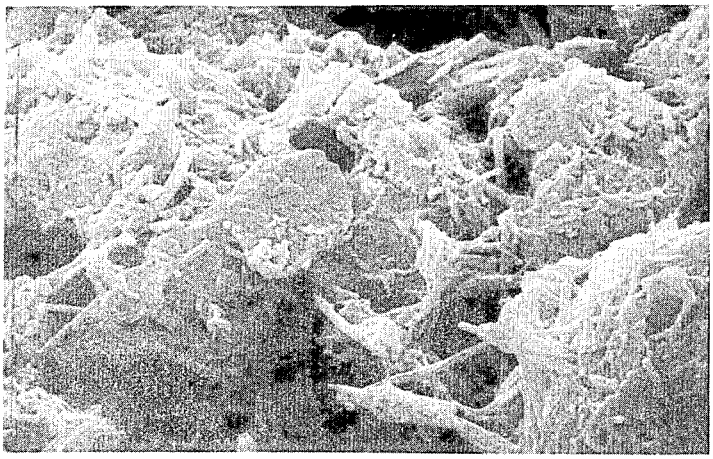
Figure 4:
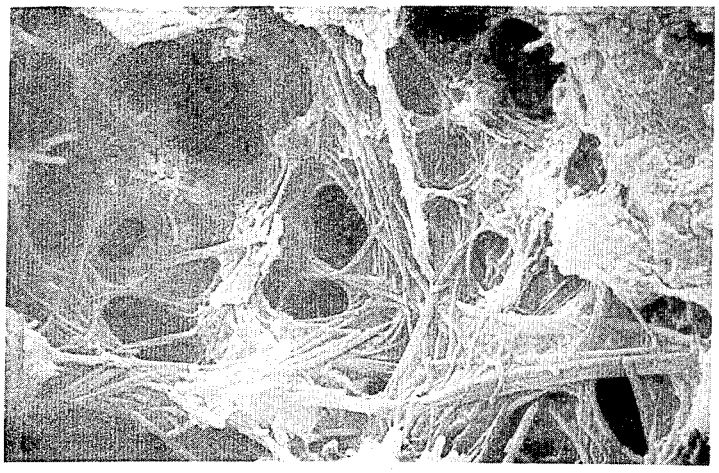
Figure 5:
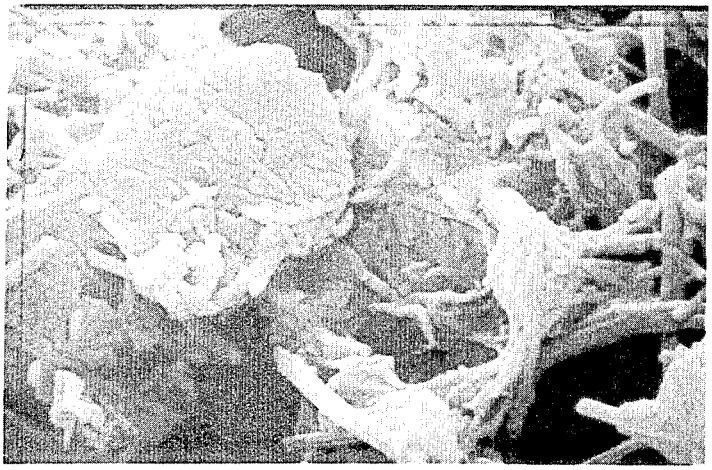
Figure 6:
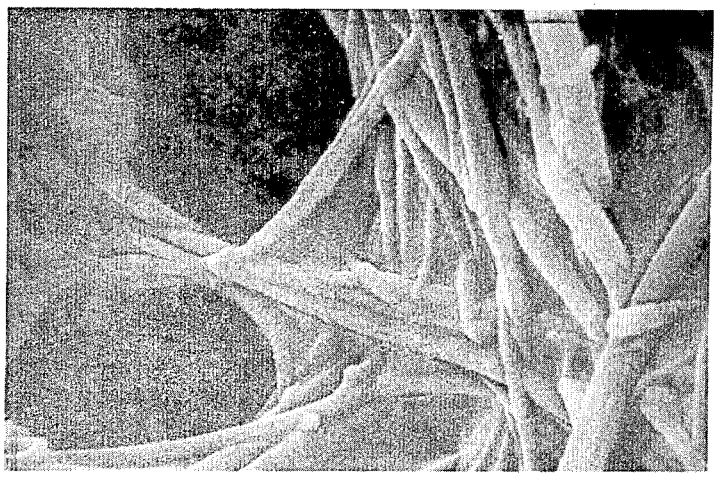
Figure 7:
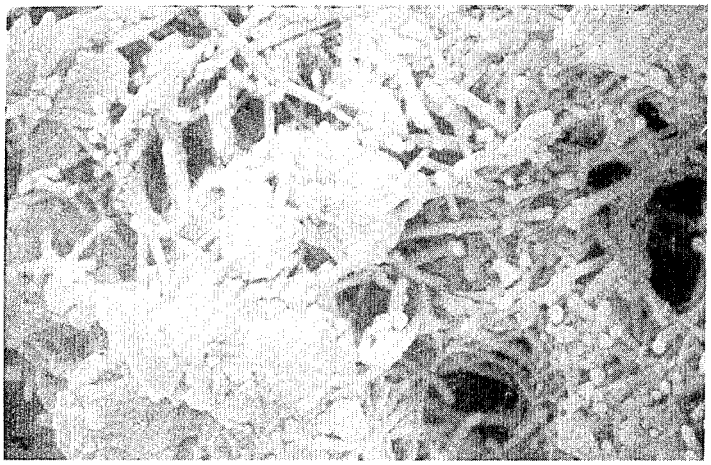
Figure 8:
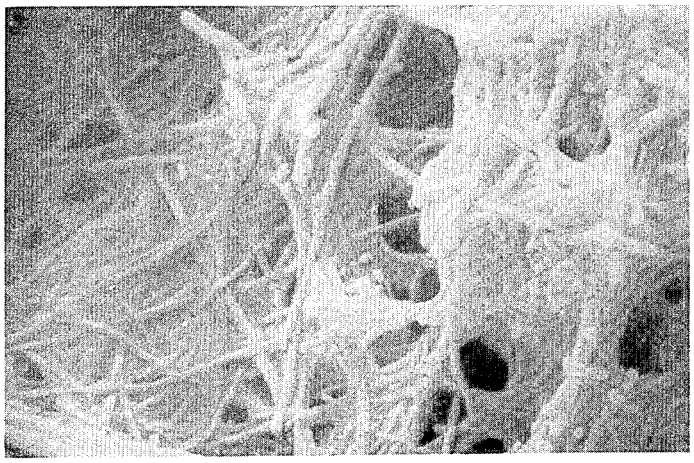

FIG. 3 is an electron photomicrograph of ore and cement,

FIG. 4 is an electron photomicrograph of ore, cement and Composition 1,

FIG. 5 is higher magnification of FIG. 3,

FIG. 6 is higher magnification of FIG. 4,

FIG. 7 is an electron photomicrograph of ore and lime, and,

FIG. 8 is an electron photomicrograph of ore, lime and Composition 1.

Figure 9:
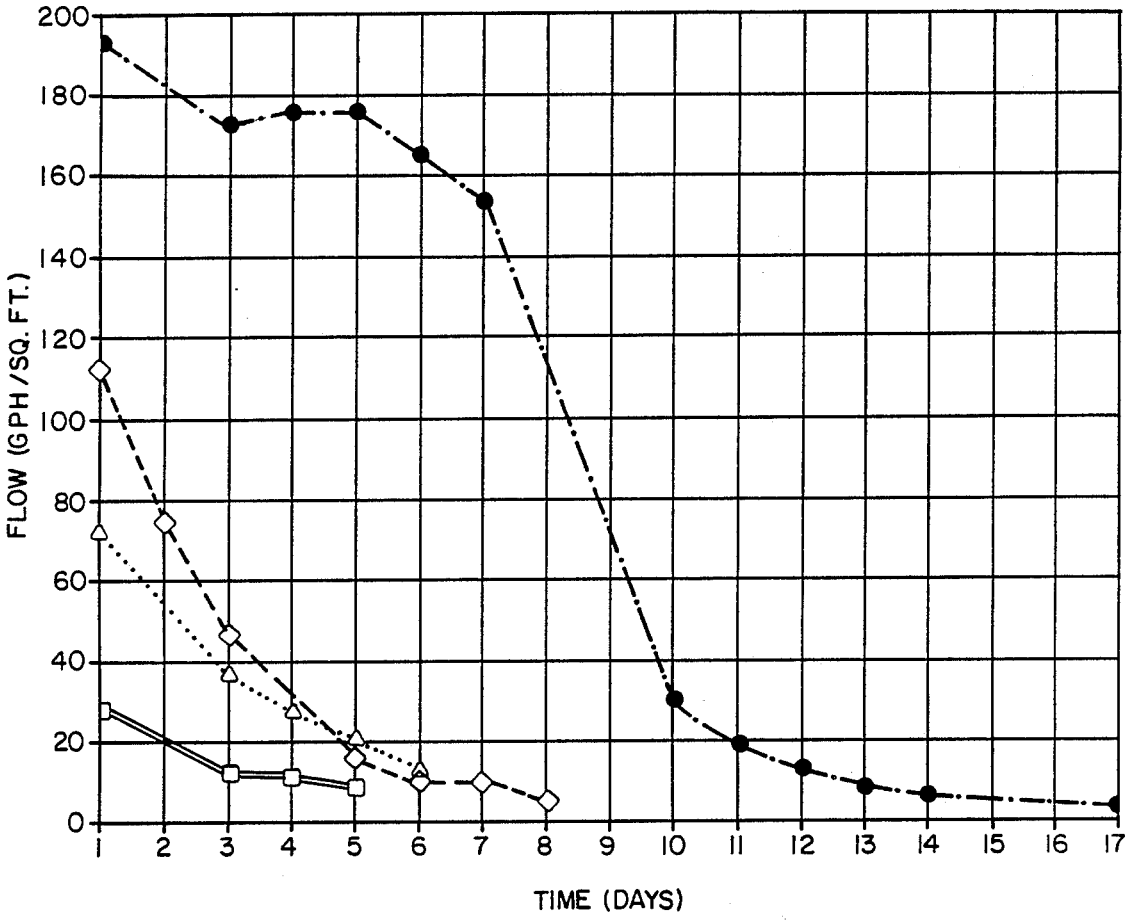

FIG. 9 is a graph showing the percolation improvement using the practice of the invention.

THE INVENTION

The invention comprises an improved process for heap leaching gold and silver ores of the type wherein the ore fines are agglomerated with an agglomeration agent, formed into a heap and then leached by percolating through the heap a cyanide solution which extracts the precious metal from the agglomerated ore for subsequent recovery, the improvement which comprises using as the agglomerating agent a water-soluble vinyl polymer having a molecular weight of at least 500,000.

THE HIGH MOLECULAR WEIGHT WATER-SOLUBLE VINYL ADDITION POLYMERS

General:

The water-soluble vinyl addition polymers are illustrated by acrylamide polymers which include polyacrylamide and its water-soluble copolymeric derivatives such as, for instance, acrylic acid, methacrylic acid, itaconic acid, acrylonitrile, and styrene. Other monomers with which acrylamide may be copolymerized include those which are cationic such as dimethyl amino ethyl methacrylate and its water-soluble quaternary salts, as well as anionic materials such as, for instance, sulfonate-containing vinyl monomers and carboxyl-containing monomers. These copolymers will generally contain from 5–95% by weight of acrylamide and will be water soluble.

Cationics:

Polymers of this type include polymers of acrylamide and dimethyl amino ethyl methacrylate and its water-soluble quaternary derivatives, polydimethyl amino ethyl methacrylate and its water-soluble quaternary derivatives and polymers and copolymers of diallyl dimethyl ammonium chloride (DADMAC) such as that described in U.S. Pat. No. 3,288,770 and further described in water-in-oil emulsion form in U.S. Pat. No. 3,920,599, the disclosures of which are incorporated herein by reference. These polymers are advantageously employed as copolymers of acrylamide. Another group of cationic polymers are the DADMAC polymers.

DADMAC:

The polymers or copolymers utilized in the water-in-oil emulsions of this invention are cationically charged polymers or copolymers of allyl amines. A preferred example of a material of this type is diallyl dimethyl ammonium chloride such as that described in U.S. Pat. No. 3,288,770 which is further described in water-in-oil emulsion form in U.S. Pat. No. 3,920,599. Also useful are polydiallyl dimethyl ammonium fluoride and bromide.

Anionics:

The anionic polymers and copolymers are anionically charged and water soluble. Examples of materials of this type include polymers of acrylic and methacrylic acid and copolymers of acrylic and methacrylic acid with other non-ionic or anionic water-soluble monomers such as acrylamide or sulfomethylated polyacrylamide. This latter type of polymers are described in European Patent Application No. 0225 596 and U.S. Pat. No. 4,703,092, the disclosures of which are incorporated herein by reference.

A preferred class of anionic polymers are the acrylamide copolymers containing sulfonate groups. Illustrative of such polymers are those described in Hoke, U.S. Pat. No. 3,692,673, European Patent Application No. 0225 596, U.S. Pat. No. 4,703,092, and U.S. Pat. No. 4,704,209, the disclosures of which are incorporated herein by reference.

These sulfonated acrylamide terpolymers contain in their structure, in addition to acrylamide:

(A) at least 1 mole % of acrylic acid; and (B) at least 1 mole % of an alkyl/aryl sulfonate substituted acrylamide.

In a preferred embodiment (A) is present in the copolymer in amounts ranging between 1–95 mole % with a preferred range being 5–70 mole %. (B) is present in the copolymer in amounts ranging between 1–50 and most preferably 5–30 mole %.

The alkyl/aryl group of the alkyl/aryl sulfonate substituted acrylamide contains between 1–10 carbon atoms with a preferred embodiment being an alkyl group of from 1–6 carbon atoms. Most preferably, the sulfonate is substituted on an alkyl group, which can be linear or branched, and contains from 1–6 carbon atoms, preferably 1–4 carbon atoms.

As indicated, the molecular weight of the polymers used in the invention should have a molecular weight of at least 500,000. Preferably, the molecular weight is at least 1 million and most preferably is at least 5 million or more. These molecular weights are weight average molecular weights.

The most preferred polymers used in the invention are the acrylamide polymers described above and most preferably are anionic acrylamide polymers which contain sulfonate groups. As previously mentioned, one preferred class are the acrylamide polymers which have been reacted with 2-AMPS[1]. The polymers of this type contain preferably between 5% up to about 50% by weight of the AMPS groups.

[1] 2-AMPS is a trademark of Lubrizol Corporation: 2-acrylamido, 2-methyl propane sulfonic acid.

It should be pointed out tht the anionically charged or modified polymers and copolymers which are utilized in this invention need only to be slightly anionically charged and must be water soluble. It will be seen by those skilled in the art that many permutations and combinations of water-soluble vinyl addition polymers can be employed.

METHOD OF PREPARING THE SULFONATED ACRYLAMIDE-CONTAINING TERPOLYMERS

The terpolymers are prepared by the transamidation reaction of an acrylamide homopolymer or an acrylamide copolymer which contains at least 1 mole % of acrylic acid with an amino alkyl sulfonate. The alkyl group of the amino alkyl sulfonate contains 1–6 and preferably 1–4 carbon atoms. Examples of the preferred starting amino alkyl sulfonates are amino methyl sulfonic acid or amino ethyl sulfonic acid, (taurine). The acrylamide polymer or copolymer is reacted with the amino alkyl sulfonate under following reaction conditions:

I. a reaction temperature of at least 100° C., and preferably at least 110° C.;

II. a reaction time of at least ¼ hour and preferably at least ½ hour;

III. a mole ratio of chemical reactant to polymer ranging between about 2:1 to about 1:50;

IV. a pressure ranging from atmospheric pressure to 35 times atmospheric pressure, or more; thereby achieving the synthesis of the sulfonate polymers described above.

V. in a compatible solvent or solvent admixture for the reactants, preferably, water, or aqueous solvents containing water miscible cosolvents, such as for example, tetrahydrofuran, polyethylene glycols, glycol, and the like.

If the starting polymer is a homopolymer of acrylamide such that no other pendant functional group is present, the condition of the reaction is such that some degree of amide hydrolysis occurs in those reactions in which water or a water containing solvent is utilized. In such cases, a carboxylate functional group is also obtained in addition to the sulfonate modified amide and any unreacted starting amide groups from the starting polymer.

When the alkyl group of the alkyl sulfonate substituted acrylamide present in the terpolymer is a methyl group, a preferred method of preparing such polymers resides in the reaction of the acrylamide polymer or acrylamide acrylic acid copolymer with formaldehyde and a bisulfite. Specifically, these polymers are prepared from acrylamide-containing polymers with sodium formaldehyde bisulfite (or formaldehyde and sodium bisulfite) in from about ¼ to about 8 hours at temperatures of at least about 100° C. and at a pH of less than 12, preferably at temperatures higher than 110° C. and at a pH of 3 to 8. Under these reaction conditions, sulfomethylamide readily forms in high conversion, based on the sodium formaldehyde bisulfite charged. Sulfite salts may be substituted for the bisulfite salts in this reaction.

WATER-IN-OIL EMULSIONS OF THE WATER-SOLUBLE VINYL ADDITION POLYMERS

It is known that acrylamide and acrylamide acrylic acid polymers as well as other water-soluble vinyl monomers may be polymerized using a so-called inverse emulsion polymerization technique. The finished product of such a polymerization process is a water-in-oil emulsion which contains the water-soluble polymer present in the aqueous phase of the emulsion. When a water-soluble surfactant is added to these emulsions, they dissolve rapidly in water and provide a convenient method for preparing aqueous solutions of these polymers.

The preparation of these emulsions is discussed in Vanderhoff, U.S. Pat. No. 3,284,393. The addition thereto of a water-soluble surfactant to permit rapid dissolution of the polymer into water is described in Reissue Pat. No. 28,474, the disclosures of which are incorporated herein by reference.

The transamidation and sulfomethylation reactions described above may be performed on the water-in-oil emulsions of the acrylamide or acrylamide-acrylic acid copolymers to provide the acrylamide terpolymers used in the invention.

Methacrylamide and methacrylic acid may be substituted for acrylamide or methacrylamide acid used in the preparation of the polymers described herein. Similarly, the acrylic acid and the starting sulfonates may be either prepared or used in the form of the free acids or as their water-soluble salts, e.g. sodium, potassium or ammonium and such forms are considered to be equivalents.

The preferred method of preparing any of the polymers of the present invention resides in the utilization of the water-in-oil emulsion polymerization technique described above.

Also, as indicated in Pat. Reissue No. 28,474, when such emulsions are added to water in the presence of a water-soluble surfactant, rapid solubilization of the polymer contained in the emulsion occurs. This represents a convenient and preferred method of preparing solutions of the polymers used as agglomerating aids.

THE USE OF THE WATER-SOLUBLE VINYL ADDITION PRODUCTS AS AGGLOMERATING AGENTS

The polymers may be used alone to agglomerate the ore fines or they may be used in conjunction with known inorganic agglomerating agents such as lime, Portland cement or clays. When the polymers are used alone, a typcial dosage range is with the weight percentage range of 0.05 to 0.5 pounds per ton based on the weight of the ores treated.

When the polymers are used in conjunction with an alternative inorganic agglomerating agent such as cement, the inorganic is added in the range of 5 to 20 pounds per ton of ore and the polymer is in the range of 0.05 to 0.5 pounds per ton of ore.

Dosage cannot be set forth with any degree of precision since it depends upon the polymer and the particular ore treated.

EVALUATION OF THE INVENTION

The invention was evaluated using a variety of aggregating agents which are set forth below in the Glossary.

Glossary

| Composition No. | |
|---|---|
| 1 | NaAMPS-acrylamide 12/88[1] MW - 5-10,000,000 |
| 2 | polyethylene oxide - MW 1,000,000 |
| 3 | latex polyacrylamide - MW 5 MM |
| 4 | latex polyacrylamide - MW 10 MM |
| 5 | latex acrylamide/Na acrylate, 92/8 - MW 15 MM |
| 6 | latex acrylamide/Na acrylate, 65/35 - MW 3-4 MM |
| 7 | latex acrylamide/Na acrylate, 65/35 - MW 10-12 MM |
| 8 | latex acrylamide/Na acrylate, 65/35 - MW 20 MM |
| 9 | dry acrylamide/Na acrylate, 65/35 - MW 10-12 MM |
| 10 | latex acrylamide/Na AMPS, 88/12 - MW 8-10 MM |

-continued

Glossary

| Composition No. | |
|---|---|
| 11 | latex acrylamide/Na AMPS, 82/18 - MW 8-10 MM |
| 12 | latex acrylamide/Na AMPS, 50/50 - MW 8-10 MM |
| 13 | cross linked TX-4299 |
| 14 | latex Na AMPS/acrylamide/Na acrylate, 10/10/80 |
| 15 | latex $SO_3/CO_2/NH_2$, 9.5/28.0/62.5 |
| 16 | latex $SO_3/CO_2/NH_2$, 10/42/48 |
| 17 | latex DMAEM Quat/acrylamide MW 500,000 |

[1]Mole ratio: Sodium acrylamido, 2-methyl propane sulfonic acid/acrylamide = 12/88

The test method was as follows:

Procedure

1. Screen ore to −4 mesh.
2. Mix ore and cement on a rotating disc for five minutes.
3. Spray water on the cascading mixture to form the agglomerates.
4. The composition to be tested is added to the spray water to get good mixing throughout the ore.
5. 1000 g of agglomerates are added to 2½" diameter percolation column.
6. Water is added at the top of the column to give an overflow and constant head.
7. Flow rate through the column is measured over time at the bottom exit tube.

The above test method was utilized to screen the additives of the invention as gold ore aggregating agents either alone or with cement. The results are set forth below in Tables I to VI and FIGS. 1 to 9.

The results presented in Table VII are a pilot plant run using the following procedure:

1. −¼" ore.
2. Mix ore and cement in a small cement mixer.
3. Spray water on the cascading mixture to form the agglomerates.
4. The composition to be tested is added to the spray water to get good mixing throughout the ore.
5. Agglomerates are added to 4" diameter leach column.
6. Sodium cyanide solution is pumped to the bottom of the column, flows up through the ore and out exit tube at the top of the column.

TABLE I

AGGLOMERATION TESTS ON GOLD ORE I
FLOW RATE (GPH/FT$^2$)

| Time (hr) | Blank | Cement 20 lbs/ton | Cement (20 lbs/ton) Comp. 2 (0.1 lb/ton) | Cement (20 lbs/ton) Comp. 7 (0.5 lb/ton) | Cement (20 lbs/ton) Comp. 17 (0.5 lb/ton) |
|---|---|---|---|---|---|
| 0 | 0 | 133 | 193 | 226 | 126 |
| 1 | 0 | 53 | 70 | 163 | 72 |
| 2 | 0 | 32 | 44 | 149 | 51 |
| 3 | 0.32 | 32 | 63 | — | — |
| 4 | — | 27 | 42 | 135 | 35 |
| 5 | 0.29 | 26 | 37 | — | — |
| 6 | — | 22 | 36 | 128 | — |
| 7 | 0.29 | 21 | 32 | — | — |
| 8 | — | 19 | 30 | 133 | — |
| 1 day | 0.29 | — | — | 110 | — |
| 3 days | — | 3.6 | 4.3 | — | 3.2 |
| 4 days | | | | 7.2 | |
| 7 days | | | | 4.0 | |

TABLE II

PERCOLATION TESTS ON GOLD ORE I
CEMENT (20 LBS/TON)
FLOW GPH/FT$^2$

| Time (hr) | No. Polymer | Comp. 10 (0.12 lb/ton) | Comp. 10 (0.25 lb/ton) | Comp. 10 (0.5 lb/ton) | Comp. 10 (0.5 lb/ton) No cement | Comp. 13 (0.5 lb/ton) | Comp. 14 (0.5 lb/ton) No cement |
|---|---|---|---|---|---|---|---|
| 0 | 149 | 212 | 209 | 265 | 237 | 91 | 209 |
| 0.5 hr | 107 | 170 | 205 | 264 | 182 | 63 | 177 |
| 1 | 91 | 142 | 172 | 261 | 151 | 48 | 144 |
| 2 | 77 | 116 | 154 | 252 | 93 | 31 | 100 |
| 3 | 70 | 112 | 151 | 237 | 65 | 24 | 77 |
| 5 | 58 | 105 | 149 | 196 | 42 | 16 | 46 |
| 7 | 53 | — | 142 | 186 | 32 | 18 | 46 |
| 1 day | 28 | 72 | 112 | 193 | 14 | 14 | 32 |
| 2 | — | — | 74 | — | 7.2 | 10 | — |
| 3 | 12 | 37 | 46 | 172 | 6.9 | 4.3 | — |
| 4 | 11 | 28 | — | 175 | | | 10.8 |
| 5 | 8.3 | 20 | 16 | 175 | | | |
| 6 | | 13 | 11 | 165 | | | |
| 7 | | | 9.4 | 154 | | | |
| 8 | | | 4.7 | — | | | |
| 9 | | | | — | | | |
| 10 | | | | 30 | | | |
| 11 | | | | 19 | | | |
| 12 | | | | 13 | | | |
| 13 | | | | 8.7 | | | |
| 14 | | | | 6.5 | | | |
| 15 | | | | — | | | |
| 16 | | | | — | | | |
| 17 | | | | 3.6 | | | |

TABLE III

PERCOLATION TESTS ON GOLD ORE I
CEMENT = 20 LBS/TON
SOLUTION pH TO 11.5 WITH CaO
FLOW RATE (GPH/FT$^2$)

| Time | Comp. 4 (0.5 lb/ton) | Comp. 5 (0.5 lb/ton) | Comp. 10 (0.5 lb/ton) | Comp. 14 (0.5 lb/ton) | (No polymer) |
|---|---|---|---|---|---|
| 0 | 209 | 363 | 233 | 223 | 149 |
| 3 hr | 142 | 270 | 182 | 165 | 70 |
| 7 hr | 116 | 252 | 177 | 151 | 53 |
| 1 day | 86 | 193 | 175 | 130 | 28 |
| 2 | 58 | 137 | 172 | 116 | — |
| 3 | — | — | — | — | 12 |
| 4 | — | — | — | — | 11 |
| 5 | 32 | 65 | 130 | 68 | 8.3 |
| 6 | 26 | 58 | 128 | 64 | |
| 7 | 23 | 46 | 116 | 53 | |
| 8 | 20 | 37 | 109 | 40 | |
| 9 | 19 | 28 | 93 | 39 | |
| 10 | — | — | — | — | |
| 11 | — | — | — | — | |

TABLE III-continued

PERCOLATION TESTS ON GOLD ORE I
CEMENT = 20 LBS/TON
SOLUTION pH TO 11.5 WITH CaO
FLOW RATE (GPH/FT$^2$)

| Time | Comp. 4 (0.5 lb/ton) | Comp. 5 (0.5 lb/ton) | Comp. 10 (0.5 lb/ton) | Comp. 14 (0.5 lb/ton) | (No polymer) |
|---|---|---|---|---|---|
| 12 | — | — | — | — | |
| 13 | 11 | 15 | 30 | 14 | |
| 14 | 5.0 | 5.0 | 19 | 8.3 | |
| 15 | | 2.3 | 13 | 5.4 | |
| 16 | | | 17 | | |
| 17 | | | — | | |
| 18 | | | — | | |
| 19 | | | 9.7 | | |
| 20 | | | 11 | | |
| 21 | | | 7.9 | | |
| 22 | | | 15 | | |
| 23 | | | 5 | | |
| 24 | | | — | | |
| 25 | | | 4.7 | | |

TABLE IV

PERCOLATION TESTS ON GOLD ORE II
FLOW RATE (GPH/FT$^2$)

| Time | Blank | Cement (20 lb/ton) | Cement (20 lb/ton) Comp. 10 (0.5 lb/ton) | Cement (20 lb/ton) Comp. 11 (0.5 lb/ton) | Cement (20 lb/ton) Comp. 12 (0.5 lb/ton) | Cement (20 lb/ton) Comp. 6 (0.5 lb/ton) | Cement (20 lb/ton) Comp. 7 (0.5 lb/ton) | Cement (20 lb/ton) Comp. 8 (0.5 lb/ton) | Comp. 10 (0.5 lb/ton) |
|---|---|---|---|---|---|---|---|---|---|
| 0 | 217 | 252 | 522 | 559 | 503 | 242 | 559 | 568 | 252 |
| 3 hr | 114 | 242 | 428 | — | — | — | — | — | 167 |
| 7 hr | 30 | 198 | 398 | — | — | — | — | — | 128 |
| 1 day | 17 | 179 | 377 | 373 | 413 | 163 | 326 | 302 | 68 |
| 2 | 3.6 | — | — | 382 | 379 | 149 | 307 | 298 | 35 |
| 3 | — | — | — | 345 | 358 | 133 | 265 | 271 | 28 |
| 4 | — | 163 | 302 | 349 | 335 | 114 | 242 | 247 | — |
| 5 | .94 | 158 | 298 | 340 | 312 | 107 | 234 | 236 | 19 |
| 6 | 1.6 | 135 | 289 | — | — | — | — | — | 17 |
| 7 | | 137 | 215 | — | — | — | — | — | 19 |
| 8 | | 133 | 228 | 261 | 261 | 79 | 170 | 191 | 16 |
| 9 | | — | — | 247 | 237 | 77 | 161 | 161 | 13 |
| 10 | | 135 | 149 | 252 | 228 | 77 | 154 | 167 | 13 |
| 11 | | 133 | 161 | | | | | | — |
| 12 | | 130 | 165 | | | | | | — |
| 13 | | 126 | 136 | | | | | | 9.4 |

TABLE IV-continued

| | PERCOLATION TESTS ON GOLD ORE II FLOW RATE (GPH/FT²) | | | | | | | | |
|---|---|---|---|---|---|---|---|---|---|
| Time | Blank | Cement (20 lb/ton) | Cement (20 lb/ton) Comp. 10 (0.5 lb/ton) | Cement (20 lb/ton) Comp. 11 (0.5 lb/ton) | Cement (20 lb/ton) Comp. 12 (0.5 lb/ton) | Cement (20 lb/ton) Comp. 6 (0.5 lb/ton) | Cement (20 lb/ton) Comp. 7 (0.5 lb/ton) | Cement (20 lb/ton) Comp. 8 (0.5 lb/ton) | Comp. 10 (0.5 lb/ton) |
| 14 | | 105 | 133 | | | | | | |
| 15 | | 105 | 119 | | | | | | |
| 16 | | — | — | | | | | | |
| 17 | | — | — | | | | | | |
| 18 | | 74 | 68 | | | | | | |
| 19 | | | | | | | | | |
| 20 | | | | | | | | | |

TABLE V

| | PERCOLATION TESTS ON GOLD ORE III FLOW RATE (GPH/FT²) | | | | | | | |
|---|---|---|---|---|---|---|---|---|
| | | | | Cement (10 lb/ton) plus | | | | |
| Time | No Agglomeration | Water Agglomeration | Cement 10 lb/ton | Comp. 7 0.4 lb/ton | Comp. 9 0.18 lb/ton | Comp. 15 .5 lb/ton | Comp. 16 0.5 lb/ton | Comp. 10 0.5 lb/ton |
| 0 | — | — | — | 466 | 205 | 77 | 552 | 280 |
| 0.5 hr | — | — | — | 130 | 51 | — | 67 | 73 |
| 1 hr | 0.62 | 0.47 | 2.8 | 99 | 37 | 18 | 56 | 51 |
| 18 hr | 0.093 | 0.14 | 1.4 | 28 | 20 | 4.2 | 20 | 16 |
| 1 day | — | — | 1.2 | 23 | 14 | 2.8 | 18 | 17 |
| 2 days | 0.093 | 0.093 | 0.82 | 19 | 12 | 2.3 | 19 | 12 |
| 5 days | 0.058 | 0.058 | 0.93 | 5.1 | 3.3 | 3.7 | 7.5 | 3.3 |
| 6 days | 0.186 | 0.056 | 0.77 | 2.8 | 1.9 | 16.3 | 4.2 | 1.9 |
| 7 days | 0.12 | 0.056 | 0.56 | 3.7 | 2.8 | 8.4 | 4.2 | 3.5 |
| 8 days | | | 0.43 | 1.4 | 1.9 | 7.5 | 1.6 | 1.4 |
| 9 days | | | 0.43 | 1.9 | 1.4 | 2.6 | 2.3 | 1.4 |
| 12 days | | | 0.47 | 1.0 | 1.8 | 0.84 | 2.2 | 0.84 |
| 13 days | | | 0.58 | 0.7 | 1.0 | 0.70 | 1.9 | 1.2 |
| 14 days | | | 0.42 | 1.0 | 1.0 | 1.2 | 1.9 | 0.93 |

TABLE VI

| | Percolation Tests on Gold Ore III Cement (10 lb/ton) Flow Rate GPH/FT² | |
|---|---|---|
| Time | Comp. 4 (0.5 lb/ton) | Comp. 3 (0.5 lb/ton) |
| 0 | 380 | 464 |
| 1 hr. | 224 | 403 |
| 2 hr. | 212 | 235 |
| 1 day | 39 | 20 |
| 2 day | 30 | 17 |
| 6 day | 17 | 10 |
| 7 day | 17 | 3.7 |

TABLE VII

| | Pilot Column Leach Tests on a Commerical Ore (0.05 oz/ton Au) Mineral Recovery (%) | |
|---|---|---|
| Cement (lb/ton | 15 | 1 |
| Comp. 10 (lb/ton) | — | 0.25 |
| Based on head assay | | |
| Au | 59.7 | 70.5 |
| Ag | 9.5 | 10.0 |
| Based on calculated head | | |
| Au | 62.1 | 72.1 |
| Ag. | 12.0 | 13.8 |

The invention may be practiced with an inverse flow, that is, a downflow (Tables VIII–X) rather than an upflow of leaching solution. Silver as well as gold may be leached either way.

Additional data show improved recovery as the amount of agglomerating agent of the present invention (e.g. Comp. 1 in water) per ton of ore is increased, compared to the blank; an increase in yield compared to the blank may also be achieved with less volume of cyanide solution if the concentration of cyanide is increased. Percents are weight of course.

Test Procedure: Downflow

1. Screen ore to $-\frac{1}{2}''$.
2. Mix ore and cement in a small cement mixer.
3. Spray NaCN solution onto the cascading mixture to form the agglomerates.
4. The composition to be tested is added to the spray water to get good mixing throughout the ore.
5. Agglomerates are added to 6" diameter leach column.
6. Sodium cyanide solution is pumped to the top of the column and allowed to percolate down through the ore.
7. Pregnant solution is collected from an exit tube at the bottom of the column and analyzed for mineral values.

TABLE VIII

PILOT COLUMN LEACH TESTS ON COMMERCIAL ORE A
0.005 gpm/FT$^2$ Flow Rate
10 lb/ton Cement

| | Agglomerating Liquid: 12% of 0.1% NaCN | | | Agglomerating Liquid: 6% of 0.2% NaCN |
|---|---|---|---|---|
| Day | Blank Au Recovery (%) | 0.25 lb/ton Comp 1 Au Recovery (%) | 0.5 lb/ton Comp 1 Au Recovery (%) | 0.25 lb/ton Comp 1 Au Recovery (%) |
| 1 | 43.0 | 52.9 | 53.3 | 45.0 |
| 2 | 47.3 | 62.0 | 67.2 | 55.8 |
| 3 | 48.0 | 63.9 | 68.5 | 57.4 |
| 4 | 50.9 | 67.4 | 70.8 | 59.8 |

TABLE IX

PILOT COLUMN LEACH TESTS
ON COMMERCIAL ORE B
12.3% Agglomerating Liquid
0.005 GPM/ft$^2$ Flow Rate

| | Cement 12 lb/ton Recovery (%) | | Composition 1 0.25 lb/ton Cement 5 lb/ton Recovery (%) | |
|---|---|---|---|---|
| Day | Au | Ag | Au | Ag |
| 1 | 25.4 | 11.3 | 32.0 | 19.7 |
| 2 | 58.3 | 15.5 | 69.4 | 24.5 |
| 3 | 61.8 | 18.1 | 71.8 | 27.3 |
| 4 | 67.0 | 21.8 | 74.8 | 30.9 |
| 5 | | 24.3 | | 33.1 |

TABLE X

PILOT COLUMN LEACH TESTS
ON COMMERCIAL ORE B
8.8% Agglomerating Liquid
0.015 GPM/ft$^2$ Flow Rate

| | Cement 12 lb/ton | | | Composition 1 0.25 lb/ton Cement 5 lb/ton | | |
|---|---|---|---|---|---|---|
| | Wt. sol. | Recovery (%) | | Wt. sol. | Recovery (%) | |
| Day | Wt. ore | Au | Ag | Wt. ore | Au | Ag |
| | 0.19 | 38.0 | 11.8 | 0.17 | 52.6 | 20.2 |
| | 0.34 | 45.9 | 16.6 | 0.31 | 60.6 | 24.6 |
| 1 | 0.65 | 52.6 | 20.8 | 0.58 | 65.7 | 28.1 |
| | 0.88 | | 22.3 | 0.80 | | 29.6 |
| 2 | 1.36 | | 24.9 | 1.23 | | 31.9 |
| | 1.58 | | 25.8 | 1.42 | | 32.8 |

TABLE X-continued

PILOT COLUMN LEACH TESTS
ON COMMERCIAL ORE B
8.8% Agglomerating Liquid
0.015 GPM/ft$^2$ Flow Rate

| | Cement 12 lb/ton | | | Composition 1 0.25 lb/ton Cement 5 lb/ton | | |
|---|---|---|---|---|---|---|
| | Wt. sol. | Recovery (%) | | Wt. sol. | Recovery (%) | |
| Day | Wt. ore | Au | Ag | Wt. ore | Au | Ag |
| 3 | 1.91 | | 27.0 | 1.75 | | 34.1 |
| | 2.06 | | 27.8 | 1.88 | | 34.9 |

I claim:

1. An improved process for heap leaching precious metal ores containing gold and silver wherein the ore fines are first agglomerated with an agglomeration agent, formed into a heap and then leached by percolating through the heap a cyanide solution which extracts the gold and silver from the agglomerated ore for subsequent recovery, the improvement in which the agglomerating agent comprises an anionic water-soluble vinyl addition polymer having a molecular weight of at least 1,000,000, selected from the group consisting of: polyacrylamide; a copolymer of acrylamide and sodium acrylate; polyacrylamide containing sulfonate groups; and a polymer of acrylamide and sodium acrylate copolymer containing sulfonate groups with 5 to 20 pounds per ton of cement, based on the weight of the ore.

2. Process according to claim 1 wherein the amount of polymeric agglomerating agent is in the range of about 0.05 to 0.5 pounds per ton based on the weight of the ore.

3. Process according to claim 2 wherein the amount of polymeric agglomerating agent is combined with 5 to 20 pounds per ton of cement based on the weight of the ore.

* * * * *

UNITED STATES PATENT AND TRADEMARK OFFICE

CERTIFICATE OF CORRECTION

PATENT NO. : 4,898,611

DATED : Feb. 6, 1990

INVENTOR(S) : Anthony E. Gross

It is certified that error appears in the above—identified patent and that said Letters Patent is hereby corrected as shown below:

On the title page:

Title page, [73] "501 Nalco Chemical Company" should read --Nalco Chemical Company--;

Column 1, line 50, after "Hill" insert --from--;

Column 12, claim 1, lines 40 and 41, cancel the word "copolymer".

Signed and Sealed this

Twenty-second Day of October, 1991

*Attest:*

*Attesting Officer*

HARRY F. MANBECK, JR.

*Commissioner of Patents and Trademarks*